US011089814B2

(12) United States Patent
Jones et al.

(10) Patent No.: US 11,089,814 B2
(45) Date of Patent: Aug. 17, 2021

(54) SHISHA DEVICE HAVING AIR FLOW PATH

(71) Applicant: PHILIP MORRIS PRODUCTS S.A., Neuchâtel (CH)

(72) Inventors: Stuart Michael Ruan Jones, Royston (GB); Yaan Thomas Kinally, Cambridge (GB); Michael Paton, Royston (GB); John Anthony Stephenson, Cambridge (GB)

(73) Assignee: Philip Morris Products S.A., Neuchatel (CH)

( * ) Notice: Subject to any disclaimer, the term of this patent is extended or adjusted under 35 U.S.C. 154(b) by 269 days.

(21) Appl. No.: 16/343,114

(22) PCT Filed: Oct. 17, 2017

(86) PCT No.: PCT/IB2017/056441
§ 371 (c)(1),
(2) Date: Apr. 18, 2019

(87) PCT Pub. No.: WO2018/073742
PCT Pub. Date: Apr. 26, 2018

(65) Prior Publication Data

US 2019/0313692 A1 Oct. 17, 2019

(30) Foreign Application Priority Data

Oct. 21, 2016 (EP) ..... 16195080

(51) Int. Cl.
*A24F 1/30* (2006.01)
*A24F 47/00* (2020.01)
*A24F 40/485* (2020.01)
*A24F 40/20* (2020.01)

(52) U.S. Cl.
CPC ..... *A24F 1/30* (2013.01); *A24F 40/485* (2020.01); *A24F 40/20* (2020.01)

(58) Field of Classification Search
None
See application file for complete search history.

(56) References Cited

U.S. PATENT DOCUMENTS 3,209,765 A * 10/1965 Shih ..... A24F 1/30 131/173
3,889,690 A 6/1975 Guarnieri
(Continued)

FOREIGN PATENT DOCUMENTS

CN 201182199 Y 1/2009
CN 105029710 11/2015
(Continued)

OTHER PUBLICATIONS

Machine translation of JP3074770U, Japan Platform for Patent Information,17 pages,[online],retrieved from the Internet,[retrieved Apr. 3, 2021],<URL: https://www.j-platpat.inpit.go.jp/p0200>. (Year: 2021).*

(Continued)

*Primary Examiner* — Dennis R Cordray
(74) *Attorney, Agent, or Firm* — Mueting Raasch Group

(57) ABSTRACT

A shisha device (100) includes a device air inlet (16); a device outlet (18); an aerosol chamber (130) and a vessel (17). The aerosol chamber has a chamber inlet (131) and a chamber outlet (18) and is configured to house a consumable comprising an aerosol-generating substrate (20). The vessel has a vessel inlet (16) and a vessel outlet (15) and defines an interior configured to contain liquid (19) when the device is in use. The device is configured such that, in use, airflow through the aerosol chamber that exits the chamber outlet exits the device outlet without flowing through the liquid stored in the vessel. Thus, water soluble constituents in the aerosol may be delivered to a user of the shisha device rather than being dissolved and trapped in the liquid in the vessel.

20 Claims, 3 Drawing Sheets

(56) References Cited

U.S. PATENT DOCUMENTS

Figure 1:
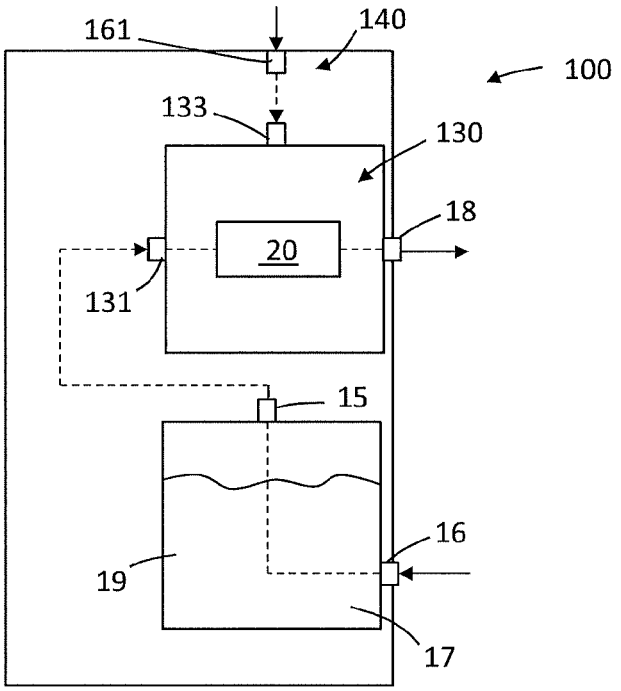

| | | | |
|---|---|---|---|
| 4,140,138 | A | 2/1979 | Keller |
| 4,219,032 | A | 8/1980 | Tabatznik |
| 9,095,174 | B2 | 8/2015 | Capuano |
| 9,380,811 | B2 | 7/2016 | Chung |
| 9,380,812 | B2 | 7/2016 | Chung |
| 9,895,641 | B2 | 2/2018 | Goldstein |
| 2008/0029107 | A1 | 2/2008 | Ruff |
| 2009/0178686 | A1 | 7/2009 | Nefraoui |
| 2010/0212679 | A1 | 8/2010 | Bishara |

FOREIGN PATENT DOCUMENTS

| | | | |
|---|---|---|---|
| CN | 204888729 | U | 12/2015 |
| EP | 2845497 | A1 | 3/2015 |
| JP | 3074770 | U | 1/2001 |

OTHER PUBLICATIONS

International Preliminary Report on Patentability issued for PCT/IB2017/056441 by the International Bureau of WIPO; dated May 2, 2019; 7 pgs.

Extended European Search Report, issued by the European Patent Office for EP 16195080.3, dated Apr. 25, 2017; 10 pgs.

International Search Report and Written Opinion for PCT/IB2017/056441, issued by the European Patent Office, dated Feb. 27, 2018; 10 pgs.

Chinese Office Action issued by the Chinese National Intellectual Property Administration dated Jun. 25, 2021 for CN Application No. 201780059901.X, 19 pgs. including English Translation.

* cited by examiner

SHISHA DEVICE HAVING AIR FLOW PATH

This application is the § 371 U.S. National Stage of International Application No. PCT/IB2017/056441, filed 17 Oct. 2017, which claims the benefit of European Application No. 16195080.3, filed 21 Oct. 2016.

This disclosure relates to shisha devices; and more particularly to shisha devices having airflow paths modified relative to conventional shisha devices.

Shisha devices are used to smoke tobacco and are configured such that smoke passes through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the smoke produced, to alter flavour, or both. Charcoal pellets are typically used to heat the tobacco in a shisha device, which may cause full or partial combustion of the tobacco or other ingredients.

An object of the present invention is to provide a shisha device that heats but does not combust an aerosol generating substrate to avoid combustion by-products from being delivered to a user of the device. Preferably, the substrate comprises tobacco.

The present inventors have found that many of the constituents of an aerosol generated by heating, without combusting, an aerosol generating substrate are water soluble. Accordingly, passing the aerosol through liquid in a water basin of a shisha device may result in reduced delivery of certain constituents of the aerosol due to the constituents being dissolved, and thus trapped, in the water.

An object of the invention is to provide a shisha device that heats but does not combust an aerosol generating substrate, and which delivers an aerosol having a desired constituent profile to a user, while maintaining an expected shisha experience.

In various aspects of the present invention there is provided a shisha device comprising a device air inlet; a device outlet; an aerosol chamber and a vessel. The aerosol chamber comprises a chamber inlet and a chamber outlet and is configured to house a consumable comprising an aerosol-generating substrate. The vessel comprises a vessel inlet and a vessel outlet and comprises an interior configured to contain liquid when the device is in use. The device is configured such that, in use, airflow through the aerosol chamber that exits the chamber outlet, and exits the device outlet bypassing the liquid stored in the vessel.

Accordingly, air drawn through the aerosol chamber that is delivered to a user during a puff does not flow through the liquid stored in the vessel. Thus, water soluble constituents in the aerosol may be delivered to a user of the shisha device rather than being dissolved and trapped in the liquid in the vessel.

In examples of shisha devices of the present invention, the device comprises an airflow path from the device inlet to the vessel inlet to the vessel outlet to the chamber inlet to the chamber outlet and then to the device outlet. The airflow path may be considered, in some respects, to be the reverse of typical shisha devices in which aerosol is carried from the aerosol chamber through liquid in the vessel prior to delivery to a user.

In examples of shisha devices of the present invention, the device comprises a first airflow path through the aerosol chamber that bypasses the liquid stored in the vessel, i.e., which does not flow through liquid stored in the vessel, and a second airflow path through liquid stored in the vessel that bypasses the aerosol chamber, i.e., which does not flow through the aerosol chamber. For example, the first airflow path may extend from the device inlet to the chamber inlet to the chamber outlet and then to the device outlet, and the second airflow path may extend from a second device inlet to the vessel inlet to the vessel outlet and then to the device outlet.

In these examples air may flow through liquid stored in the vessel to produce bubbles in the liquid when a consumer draws on the shisha device via the device outlet or a hose coupled to the device outlet. Because bubbles are formed when a user draws on a typical shisha device, a user of a shisha device of the present invention can realize a typical shisha experience despite the airflow path being modified relative to typical shisha devices.

A shisha device of the present invention may include a one-way valve between the vessel inlet and the vessel outlet. The one-way valve is configured to allow airflow from the vessel inlet to the vessel outlet and to prevent airflow from the vessel outlet to the vessel inlet. The valve may be positioned in the vessel such that it is in contact with liquid stored in the vessel when the device is in use. The valve preferably prevents flow of liquid stored in the vessel past the valve towards the vessel inlet, but readily opens when the user draws on the device outlet or a hose coupled to the device outlet to cause air to flow past the valve from the vessel inlet to the vessel outlet.

The shisha device may include a conduit having a first end operably coupled to the vessel inlet and a second end extending into the interior of the vessel below a liquid fill level. The liquid fill level is the level to which the vessel is configured to be filled when the shisha device is in use. Accordingly, air that passes from the vessel inlet to the vessel outlet passes through liquid stored in the vessel to create bubbles when a user draws on the shisha device via the device outlet. In some examples, the one-way valve may be positioned in the conduit.

In examples of a shisha device of the present invention, the device is configured such that air that flows through the aerosol chamber from the chamber inlet to the chamber outlet flows through the aerosol-generating substrate when the substrate is positioned in the aerosol chamber. The air may flow over the substrate or across the substrate in some embodiments. Preferably, at least some of the air flows through the substrate or a consumable comprising the substrate.

The size and shape of the first device inlet, second device inlet if present, the vessel inlet, the vessel outlet, the chamber inlet, and the chamber outlet may be varied to achieve a desired relative flow rates, resistance to draw, and other flow characteristics through the device and through portions of the device. Such flow characteristics may also be achieved by the size and shape of conduits, or flow restrictors or valves within one or more flow paths of the shisha device.

In examples of a shisha device of the present invention, the device includes an air valve to tailor the resistance to draw of the shisha device. Preferably the air valve is in communication with the exterior of the device and the interior of the aerosol chamber.

A shisha device of the present invention may have any suitable resistance to draw (RTD). For example, the RTD of the shisha devices may be from about 70 to about 120 mm $H_2O$. The RTD of a shisha device refers to the static pressure difference between the device inlet and the device outlet when it is traversed by an air flow under steady conditions in which the volumetric flow is 17.5 millilitres per second at the output end.

In examples of a shisha device of the present invention, the device comprises a heating element disposed in the aerosol chamber. The heating element is configured to heat the aerosol-generating substrate to generate an aerosol for inhalation by a user of the device.

Preferably, the heating element is configured to heat the substrate to an extent sufficient to generate an aerosol without combusting the aerosol-generating substrate. The heating element may be operably coupled to control electronics configured to control the temperature of the heating element such that the heating element heats the aerosol-generating substrate to an extent sufficient to generate an aerosol without combusting the substrate.

The shisha device may comprise a receptacle configured to receive a consumable comprising the aerosol-generating substrate. The heating element is positioned relative to the receptacle such that when the consumable is received in the receptacle the heating element may heat the aerosol-generating substrate to an extent sufficient to generate an aerosol without combusting the aerosol-generating substrate.

In some examples of shisha devices of the invention, the receptacles are configured to receive consumables comprising aerosol-generating substrate configured to deplete in about 3 minutes to about 8 minutes when heated by one or more heating elements. The device may comprise a sufficient number of receptacles and associated heating elements such that sequential heating of aerosol-generating substrate in consumables received by the receptacles results in depletion of the aerosol-generating substrate of the last consumable to be heated at least 30 minutes after initial heating the aerosol-generating substrate of the first consumable to be heated.

In some examples, a shisha device may comprise a holder defining a receptacle configured to receive a consumable comprising the aerosol-generating substrate. The heating element extends into the receptacle and is configured to penetrate into at least a portion of the aerosol-generating substrate when the consumable is received by the receptacle. The heating element may comprise, for example, a blade configured to pierce consumable to penetrate into the aerosol-generating substrate. The holder may define a plurality of receptacles. Each receptacle may be configured to receive a consumable comprising aerosol-generating substrate. The device may comprise a plurality of heating elements. At least one of the plurality of heating elements may extend into each receptacle. The shisha device may comprise control electronics operably coupled to the plurality of heating elements and configured to control heating of the plurality of heating elements. In some examples, the control electronics are configured to cause heating of a first heating element extending into a first receptacle until the aerosol-generating substrate of the consumable in the first receptacle is depleted (or nearly depleted), and configured to cause heating of a second heating element in a second receptacle after the aerosol-generating substrate of the consumable in the first receptacle is depleted (or nearly depleted).

In some examples, the shisha device comprises an inductive heating engine, comprising a induction coil, configured to induce eddy currents and/or hysteresis losses in a susceptor material, which thereby is heated. The susceptor material is in thermal contact with the aerosol generating substrate. In some embodiments, the susceptor forms part of an aerosol generating article, preferably provided as a susceptor embedded in the aerosol generating substrate, or provided as particles in the aerosol generating substrate.

In some examples, shisha devices of the present invention may be used with consumables comprising aerosol-generating substrates and combustible heat sources. Preferably, the combustible heat source is positioned such that combustion by-products are not present in aerosol generated by heating the aerosol-generating substrate. For example, the combustible heat source may be isolated from airflow through the aerosol chamber and heat due to combustion of the heat source may be transferred to the aerosol generating substrate by thermal conduction through one or more thermally conductive materials in thermal contact with the aerosol generating substrate and the heat source. Suitable conductive materials include metal or metal foil such as, for example, aluminum foil, steel, iron foil and copper foil; and metal alloy foil. Preferably the heat source is a combustible heat source comprising carbon and one or more ignition aid.

In some examples, shisha devices of the present invention may be used with aerosol-generating substrates that are combusted, such as aerosol generating substrates that comprise tobacco. However, the shisha devices of the present invention are preferably used with aerosol generating substrates that are configured to be heated but not combusted to generate aerosol.

Any suitable aerosol-generating substrate may be used with shisha devices of the invention. The aerosol-generating substrate is preferably a substrate capable of releasing volatile compounds that can form an aerosol. The volatile compounds may be released by heating the aerosol-generating substrate. The aerosol-generating substrate may be solid or liquid or comprise both solid and liquid components. In a preferred embodiment, the aerosol-generating substrate is solid.

The aerosol-generating substrate may comprise nicotine. The nicotine containing aerosol-generating substrate may comprise a nicotine salt matrix. The aerosol-generating substrate may comprise plant-based material. The aerosol-generating substrate may comprise tobacco, and preferably the tobacco containing material contains volatile tobacco flavor compounds, which are released from the aerosol-generating substrate upon heating.

The aerosol-generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 5% and 30% by weight on a dry weight basis.

The aerosol-generating substrate may alternatively or additionally comprise a non-tobacco-containing material. The aerosol-generating substrate may comprise homogenized plant-based material.

The aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-generating substrate preferably comprises nicotine and at least one aerosol-former. In a particularly preferred embodiment, the aerosol-former is glycerine.

The solid aerosol-generating substrate may be in loose form, or may be provided in a suitable consumable such as container or cartridge.

The solid aerosol-forming substrate may be provided on or embedded in a thermally stable carrier. In a preferred embodiment, the carrier is a tubular carrier having a thin layer of the solid substrate deposited on its inner surface, or on its outer surface, or on both its inner and outer surfaces. Such a tubular carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets.

The carrier may be a non-woven fabric or fiber bundle into which tobacco components have been incorporated. The non-woven fabric or fiber bundle may comprise, for example, carbon fibers, natural cellulose fibers, or cellulose derivative fibers.

In a preferred embodiment, the aerosol-generating substrate comprises a tubular substrate having a cavity for receiving the at least one heater element. The heater element may, thus, penetrate into the aerosol-generating substrate. As used herein, "penetrate" in the context of a heating element penetrating into an aerosol-generating substrate, means that the heating element or a portion of the heating element extends into a consumable containing the substrate or extends into a portion of the substrate. For reference, placing an aerosol-generating substrate on a flat heating element, such that the substrate lies on a surface of the heating element, does not constitute the heating element penetrating into the aerosol-generating substrate. However, heating elements and substrates configured in such a manner may be used in examples of shisha devices of the present invention.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Referring now to FIG. 1, a schematic drawing of an example of a shisha device 100 is shown. The device 100 includes a vessel 17 defining an interior volume configured to contain liquid 19 and defining an outlet 15 and an inlet 16, which in the embodiment depicted in FIG. 1 is the device inlet 16. The liquid 19 preferably comprises water, which may optionally be infused with one or more colorants, one or more flavorants, or one or more colorants and one or more flavorants. For example, the water may be infused with one or both of botanical infusions or herbal infusions. The device 100 also includes an aerosol chamber 130 defining an inlet 131 and an outlet 18, which in the embodiment depicted in FIG. 1 is the device outlet 18. The aerosol chamber 130 may be configured to receive an aerosol generating substrate 20 or a consumable comprising an aerosol generating substrate. When heated by, for example, a heating element (not shown in FIG. 1), the substrate 20 generates an aerosol that may be delivered via an airflow path defined by the device and components of the device for delivery to a user through the outlet 18.

The air flow path through the shisha device 100 depicted in FIG. 1 is shown in dashed lines and arrows. When a user draws on the device outlet 18 or a hose coupled to the outlet 18, air enters the device 100 via the device inlet 16, which also serves as the vessel 17 inlet in depicted example. Air then flows through liquid 19 stored in the vessel 17 to the vessel outlet 15 and may cause bubbles to form in the liquid 19 as the air flows through the liquid 19 in the vessel 17. From the vessel outlet 15 air flows to the chamber inlet 131 through the aerosol chamber 130, and preferably through a consumable comprising the aerosol generating substrate 20 and out of the chamber 130 through outlet 18 for delivery to a user.

The shisha device 100 shown in FIG. 1 also includes an optional airflow valve 140 in communication with the aerosol chamber 130 to tune the resistance to draw of the device 100. Any suitable valve 140 may be used. In some embodiments, the valve 140 comprises one or more flow restrictor openings or channels. The valve 140 is in communication with the exterior of the device 100 via inlet 161 and the interior of the aerosol chamber 130 via chamber inlet 133.

Figure 2:
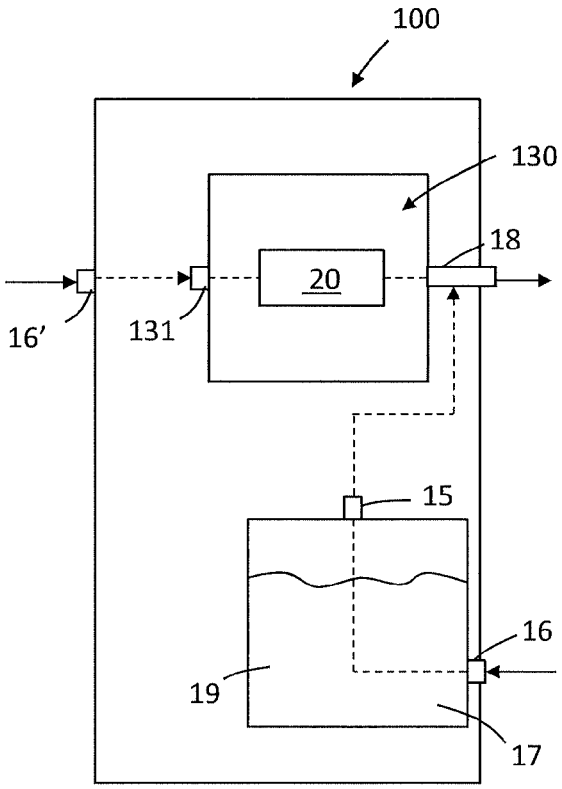

Referring now to FIG. 2, an example of a shisha device 100 having a split airflow path is shown. The device 100 includes a vessel 17 defining an interior volume configured to contain liquid 19 and defining an outlet 15 and an inlet 16, which in the embodiment depicted in FIG. 2 is a device inlet 16. The device 100 also includes a second inlet 16' in communication with an aerosol chamber 130 that defines an inlet 131 and an outlet 18, which in the embodiment depicted in FIG. 2 is the device outlet 18. The aerosol chamber 130 is configured to receive an aerosol generating substrate 20 or a consumable comprising an aerosol generating substrate. When heated by, for example, a heating element (not shown in FIG. 2), the substrate 20 generates an aerosol that may be delivered via an airflow path defined by the device and components of the device for delivery to a user through the outlet 18.

The airflow paths through the shisha device 100 depicted in FIG. 2 are shown in dashed lines and arrows. When a user draws on the device outlet 18 or a hose coupled to the outlet 18, air enters the device 100 via device inlet 16' and flows through the chamber inlet 131 through the aerosol chamber 130, and preferably through a consumable comprising the aerosol generating substrate 20, and out of the chamber 130 through outlet 18 for delivery to a user.

The shisha device 100 depicted in the example of FIG. 2 also defines a second air flow path. When a user draws on the device outlet 18 or a hose coupled to the outlet 18, air enters the device 100 via device inlet 16, which also serves as the vessel 17 inlet in depicted example. Air then flows through liquid 19 stored in the vessel 17 to the vessel outlet 15 and may cause bubbles to form in the liquid 19 as the air flows through the vessel 17. From the vessel outlet 15 the air flows to the device outlet 18 for delivery to the user. Prior to delivery to the user the air from the second airflow path mixes with the aerosol carried in the first air flow path. This may occur prior to the two flow streams exiting the device via outlet 18, in a hose (not depicted in FIG. 2) coupled to the outlet 18, or both prior exiting the outlet 18 and in the hose.

The airflow paths depicted in FIGS. 1-2 are examples of airflow paths that shisha devices may have. Shisha devices in accordance with the present invention may have any other suitable airflow paths that allow aerosol from the aerosol chamber to be delivered to a user without flowing through the liquid stored in the vessel. Preferably, the shisha devices are also configured to allow air flow through the liquid in the vessel to combine with the aerosol delivered to the user, such as described regarding FIGS. 1-2 or in any other suitable manner. In other embodiments, a valve or valves may be provided to control the ratio of the split between the various airflow paths. This valve or valves may be adjustable by a user of the device 100.

Figure 3:
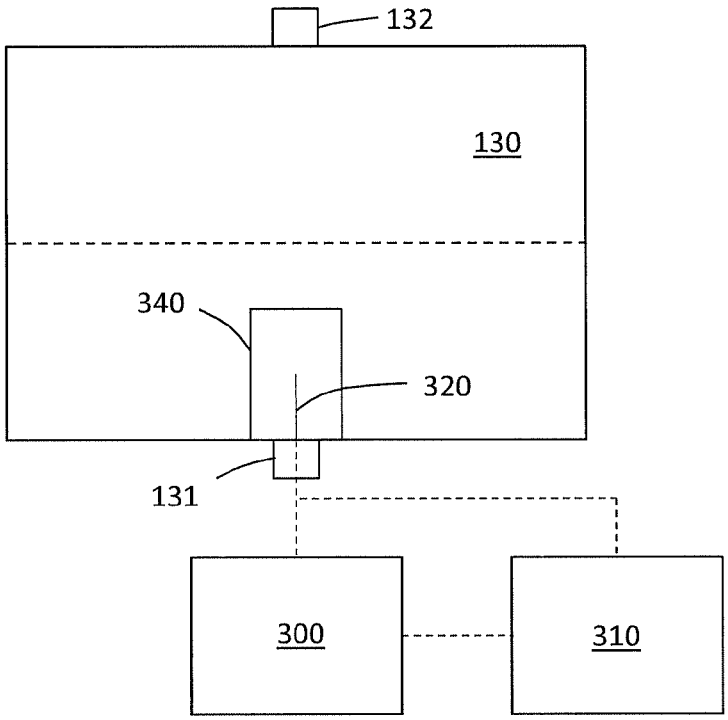

Referring now to FIG. 3, a schematic block drawing of heating and control components and sectional view of an aerosol chamber 130 that may be included in a shisha device of the present invention is shown. A receptacle 340 is disposed in, or is in communication with, the aerosol chamber 130. The receptacle 340 defines an opening for receiving a consumable that comprises an aerosol generating substrate. When the consumable is inserted into the receptacle 340, a heating element 320 is placed into thermal contact with the aerosol generating substrate. Any suitable heating element 320 may be used. Preferably, the heating element is formed of an electrically resistive material that heats when a current or voltage is applied to the element. In some embodiments, the heating element 320 comprises a blade configured to pierce a consumable to place the element 320 in contact with the aerosol generating material when the consumable is inserted into the receptacle 340.

Aerosol generated from the heated substrate can be carried in an airstream defined by a flow path through the chamber 130 from the chamber inlet 131 to the chamber outlet 132, which may be the device outlet (for example, outlet 18 depicted in FIGS. 1-2). The heating element 320 is operably coupled to control electronics 300 and power supply 310 to control the temperature of the heating element 320 so that the heating element 320 heats the aerosol generating substrate to a sufficient extent to generate an aerosol but not burn the substrate.

Control electronics 300 may be provided in any suitable form and may, for example, include a controller or a memory and a controller. The controller can include one or more of an Application Specific Integrated Circuit (ASIC) state machine, a digital signal processor, a gate array, a microprocessor, or equivalent discrete or integrated logic circuitry. Control electronics 300 can include memory that contains instructions that cause one or more components of the circuitry to carry out a function or aspect of the control electronics. Functions attributable to control electronics 300 in this disclosure can be embodied as one or more of software, firmware, and hardware.

The control electronics 300 may be configured to monitor the electrical resistance of the heating element, and to control the supply of power to the heating element dependent on the electrical resistance of the heating element.

The electronic circuitry may comprise a microprocessor, which may be a programmable microprocessor. The electronic circuitry may be configured to regulate a supply of power. The power may be supplied to the heater element in the form of pulses of electrical current.

The power supply 310 may include one or more batteries or other suitable power supply operably coupled to the heating element 320 and the control electronics 300. Regardless of the type of power supply employed, the power supply preferably provides sufficient energy for the normal functioning of the device for approximately 70 minutes of continuous operation of the device, before being recharged or needing to connect to an external electrical power source.

The aerosol chamber 130 may be formed from one or more parts. Preferably, the aerosol chamber comprises a portion that may be removed or opened to allow a user to insert a consumable into the receptacle. For example, a portion of the chamber 130 depicted in FIG. 3 that is above the dashed line may be removed to allow the consumable to be inserted. In some embodiments, the top portion of the chamber 130 may be formed by a cover or lid of the shisha device.

Figure 4:
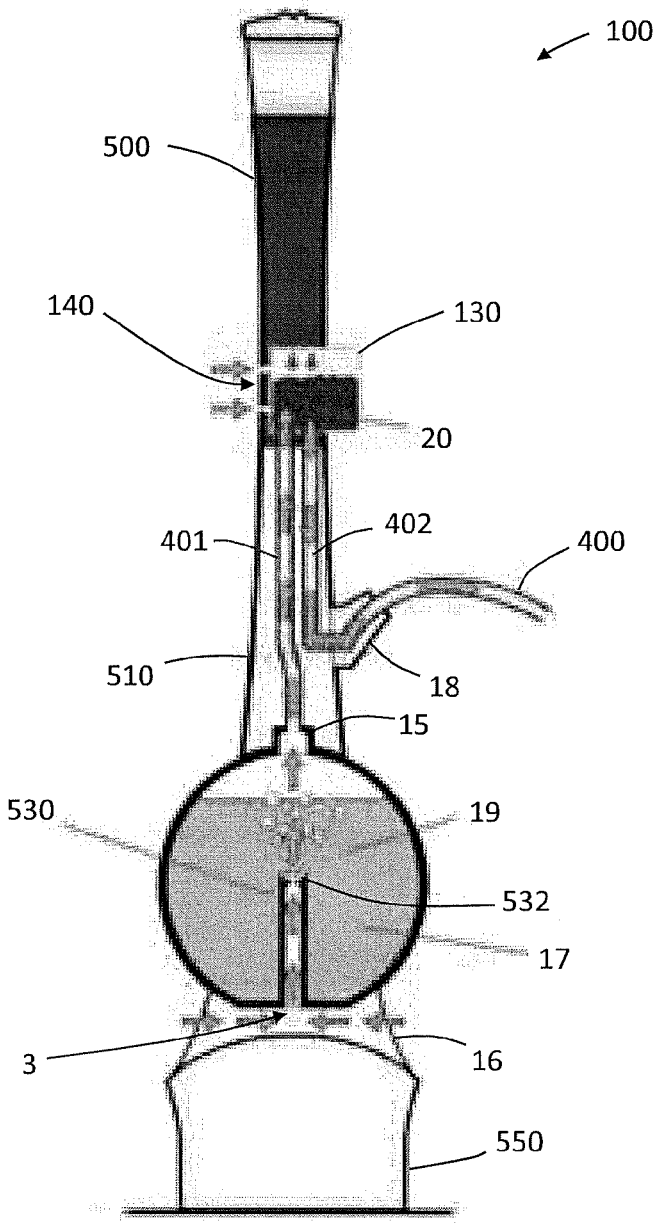

Referring now to FIG. 4, a schematic drawing of a shisha device 100, in which the aerosol chamber 130 is enlarged, is shown. The device 100 includes a removable cover 500. In use, the cover 500 may engage a heating assembly to form at least a portion of the aerosol chamber 130 within a space defined by the cover 500. The cover 500 may be removed to insert or remove the aerosol generating substrate 20 or consumables comprising the aerosol generating substrate. The device 100 further includes an extension 510 between the cover 500 and a vessel 17 configured to house liquid 19, such as water. Conduits 401, 402 forming a portion of an airflow path may run through the extension 510. Conduit 401 couples an inlet into the aerosol chamber 130 to the outlet 15 of the vessel 17. Conduit 402 couples an outlet of the aerosol chamber 130 to device outlet 18. Hose 400 may be coupled to device outlet 18 in any suitable manner, such as a quick-release type connector, bayonet-type connector, threaded engagement connector, or interference fit. In some embodiments, conduit 402 and hose 400 are formed from a single piece of tubing, and thus hose 400 is an extension of conduit 402.

The device 100 includes a base 550 configured to hold vessel 17. In some embodiments, base 550 and vessel 17 together are a single part. Device inlet 16 is formed in base 550 and is in communication with vessel inlet 3. When a user draws on hose 400, air enters device inlet 16 and flows through vessel inlet 3 through conduit 530 extending into the vessel 17 below a liquid 19 fill level. A one-way valve 532 is disposed in conduit 530 to prevent liquid 19 from flowing through the conduit 530 towards the inlet 3. When the air flow exits the conduit 530 bubbles are formed in the liquid. Air then flows through vessel outlet 15, through conduit 401 into aerosol chamber 130 through the aerosol generating substrate. Aerosol from the substrate 20 is entrained in air that flows through conduit 402 to hose 400 for delivery to a user of the device 100. In addition, airflow through valve 140 serves to tune the resistance to draw of the device.

While the devices depicted in FIGS. 1, 2, and 4 are shown as having only one device outlet 18, shisha devices in accordance with the present invention may have more than one device outlet.

For purposes of example, one method for using a shisha device as described herein is provided below in chronological order. For purposes of example, reference is made to components illustrated in FIG. 3. The vessel 17 may be detached from the shisha device 100 and filled with water. One or more of natural fruit juices, botanicals, and herbal infusions may be added to the water for flavoring. The amount of liquid added should cover the conduit 530 but should not exceed a maximum level mark that may optionally exist on the vessel 17. The vessel 17 is then reassembled to the shisha device 100. The cover 500 is removed and aerosol generating substrate 20, such as a consumable comprising the substrate, is placed in contact with a heating element (not shown in FIG. 3), such as in a receptacle into which a heating element blade extends. The cover 500 is then reassembled to the shisha device 100. The device 100 is then turned on to heat the aerosol generating substrate 20. A user may puff from a mouth piece coupled to the hose 400 until a desired volume of aerosol is produced to fill the aerosol chamber 130, which may be in whole or in part defined by the inner volume of the cover 500.

A shisha device of the invention may be of any suitable size and shape. For example, the total height of the shisha device as fully assembled can be of approximately 180 mm to 410 mm, preferably from 210 to 320 mm. The total width can be of approximately 60 to 180 mm in its narrower transversal cross section and of approximately 80 mm to 200 mm in its larger transversal cross section, as probably coincident to its lower extremity (base). The size of the device may vary to accommodate differing numbers of consumables. For example, a device may accommodate from 1 to 25 consumables, preferably from 4 to 21, and more preferably from 4 to 8 consumables at a time.

A shisha device of the invention may be predominately cylindrical, including fully cylindrical in its external shape.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers maybe used to ensure hermetic sealing.

Sealing rings and sealing washers may be made of any suitable material or materials. For example, the seals may comprise one or more of graphene compounds and silicon compounds. Preferably, the materials are approved for use in humans by the U.S. Food and Drug Administration.

Aerosol may be purged from the cover or the vessel at any time by removing the cover or the vessel from the shisha device. Alternatively, a purging valve may be incorporated in the cover or the vessel to enable purging of aerosol without opening the device.

Main parts, such as the conduit, the cover, and the vessel may be made of any suitable material or materials. For example, these parts may independently be made of glass, glass-based compounds, polysulfone (PSU), polyethersulfone (PES), or polyphenylsulfone (PPSU). Preferably, the parts are formed of materials suitable for use in standard dish washing machines.

Other parts may be formed from any suitable materials. In some examples, one or both of holders and extracting units of the invention may be water resistance for normal cleaning or washing with normal water, including use in standard dish washing machines. For example, such parts may comprise transparent or pigmented compounds of polysulfone (PSU), polyethersulfone (PES) or polyphenylsulfone (PPSU), or compounds that are not transparent such as polyether ether ketone (PEEK).

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Thus, methods, systems, apparatuses, assemblies and articles for shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol generating article manufacturing or related fields are intended to be within the scope of the following claims.

The invention claimed is:

1. A shisha device comprising:

a first device inlet;

a device outlet;

an aerosol chamber configured to house a consumable comprising an aerosol-generating substrate, wherein the aerosol chamber comprises a chamber inlet and a chamber outlet; and a vessel comprising an interior configured to contain liquid when the device is in use, wherein the vessel comprises a vessel inlet and a vessel outlet, wherein the device is configured such that, in use, airflow through the aerosol chamber that exits the chamber outlet exits the device outlet bypassing the liquid stored in the vessel, wherein the device comprises an airflow path from the first device inlet to the vessel inlet to the vessel outlet to the chamber inlet to the chamber outlet and then to the device outlet.

2. The shisha device according to claim 1, wherein the vessel inlet is the first device inlet.

3. The shisha device according to claim 1, wherein airflow through the vessel from the vessel inlet to the vessel outlet is configured to flow through liquid housed in the vessel when a user puffs on the device.

4. The shisha device according to claim 3, further comprising a one-way valve between the vessel inlet and the vessel outlet, wherein the one-way valve allows airflow from the vessel inlet to the vessel outlet and prevents airflow from the vessel outlet to the vessel inlet.

5. The shisha device according to claim 3, further comprising a conduit having a first end operably coupled to the vessel inlet and a second end extending into the interior of the vessel below a liquid fill level.

6. The shisha device according to claim 1, wherein the device is configured such that air that flows through the aerosol chamber from the chamber inlet to the chamber outlet flows through the aerosol-generating substrate, when positioned in the aerosol chamber.

7. The shisha device according to claim 1, wherein the shisha device further comprises a heating element disposed in the aerosol chamber, wherein the heating element is configured to heat the aerosol-generating substrate to an extent sufficient to generate an aerosol without combusting the aerosol-generating substrate.

8. The shisha device according to claim 7, wherein the heating element is operably coupled to control electronics configured to control the temperature of the heating element to cause the heating element to heat the aerosol-generating substrate to an extent sufficient to generate an aerosol without combusting the aerosol-generating substrate.

9. The shisha device according to claim 8, wherein the shisha device comprises a receptacle configured to receive a consumable comprising the aerosol-generating substrate, wherein the heating element is positioned relative to the receptacle such that when the consumable is received in the receptacle the heating element may sufficiently heat the aerosol-generating substrate to an extent to generate an aerosol without combusting the aerosol-generating substrate.

10. The shisha device according to claim 1, further comprising an air flow valve in communication with the aerosol chamber to control the resistance to draw of the shisha device.

11. The shisha device according to claim 1, wherein the shisha device outlet is the chamber outlet.

12. A shisha device comprising:

a first device inlet;

a device outlet;

an aerosol chamber configured to house a consumable comprising an aerosol-generating substrate, wherein the aerosol chamber comprises a chamber inlet and a chamber outlet; and a vessel comprising an interior configured to contain liquid when the device is in use, wherein the vessel comprises a vessel inlet and a vessel outlet, wherein the device is configured such that, in use, airflow through the aerosol chamber that exits the chamber outlet exits the device outlet bypassing the liquid stored in the vessel, wherein the device comprises a first airflow path through the aerosol chamber that bypasses liquid stored in the vessel, and wherein the device comprises a second airflow path through liquid stored in the vessel that bypasses the aerosol chamber.

13. The shisha device according to claim 12, further comprising a second device inlet, wherein the first airflow path extends from the first device inlet to the chamber inlet to the chamber outlet and then to the device outlet, and wherein the second airflow path extends from the second device inlet to the vessel inlet to the vessel outlet and then to the device outlet.

14. The shisha device according to claim 13, wherein the vessel inlet is the second device inlet.

15. The shisha device according to claim 12, wherein airflow through the vessel from the vessel inlet to the vessel outlet is configured to flow through liquid housed in the vessel when a user puffs on the device.

16. The shisha device according to claim 15, further comprising a one-way valve between the vessel inlet and the vessel outlet, wherein the one-way valve allows airflow from the vessel inlet to the vessel outlet and prevents airflow from the vessel outlet to the vessel inlet.

17. The shisha device according to claim 12, wherein the device is configured such that air that flows through the aerosol chamber from the chamber inlet to the chamber outlet flows through the aerosol-generating substrate, when positioned in the aerosol chamber.

18. The shisha device according to claim 12, wherein the shisha device further comprises a heating element disposed in the aerosol chamber, wherein the heating element is configured to heat the aerosol-generating substrate to an extent sufficient to generate an aerosol without combusting the aerosol-generating substrate.

19. The shisha device according to claim 12, further comprising an air flow valve in communication with the aerosol chamber to control the resistance to draw of the shisha device.

20. The shisha device according to claim 12, wherein the shisha device outlet is the chamber outlet.

* * * * *